US005393159A

United States Patent [19]

Traspuesto Miguel

[11] Patent Number: 5,393,159

[45] Date of Patent: Feb. 28, 1995

[54] BASE FOR AERIALS

[75] Inventor: Francisco J. Traspuesto Miguel, Vigo, Spain

[73] Assignee: Plasticos Dik, S.A., Vigo, Spain

[21] Appl. No.: 253,605

[22] Filed: Jun. 3, 1994

Related U.S. Application Data

[63] Continuation of Ser. No. 983,214, Nov. 30, 1992, abandoned.

[30] Foreign Application Priority Data

Nov. 29, 1991 [ES] Spain ..... 91.02677

[51] Int. Cl.[6] ..... H01Q 1/32

[52] U.S. Cl. ..... 403/91; 403/120; 343/882

[58] Field of Search ..... 343/715, 714, 713, 880, 343/882; 403/91, 92, 93, 120; 248/291, 289.1, 224.3

[56] References Cited

U.S. PATENT DOCUMENTS

| | | | |
|---|---|---|---|
| 2,565,012 | 8/1951 | Barrett | 248/289.1 |
| 2,573,032 | 10/1951 | Lambert | 403/92 |
| 4,109,251 | 8/1978 | MacDougall | 343/715 |
| 4,115,779 | 9/1978 | Dantzler | 343/715 |
| 4,183,490 | 1/1980 | Montanarini | 248/291 |

FOREIGN PATENT DOCUMENTS

| | | | |
|---|---|---|---|
| 2347564 | 11/1977 | France | 403/91 |
| 2575979 | 7/1986 | France | 343/713 |
| 1016329 | 9/1957 | Germany | 343/715 |
| 84210 | 4/1991 | Japan | 403/120 |

*Primary Examiner*—Randolph A. Reese
*Assistant Examiner*—Anthony Knight
*Attorney, Agent, or Firm*—Jacobson, Price, Holman & Stern

[57] ABSTRACT

The invention relates to a holding device specially designed for fitting aerials to the roof of motor vehicles, comprising a U-shaped support (1), between the side branches of which is located and retained with the possibility of rotating about its own axis a moveable component (2) to which an aerial is secured and within which is located a helical spring (5) which expands between one of the side branches and an internal rim (6) provided adjacent one of the edges of the component (2), forcing the rim (6) against the other side branch of the support and generating a friction force opposing rotational movements of the aerial.

10 Claims, 2 Drawing Sheets

BASE FOR AERIALS

This is a continuation of application Ser. No. 07/983,214, filed Nov. 30, 1992, which was abandoned upon the filing hereof.

BACKGROUND OF THE INVENTION (i) Field of the invention

The present invention relates to a base (holding device) which, though also suitable for other applications, has been specially designed for installing aerials, and more particularly, for installing aerials onto the roof of a motor vehicle.

(ii) Brief Description of the Prior Art

As is already well known mounting bases for aerials allow rotation thereof, within a relatively wide arc, and ensure their retention by friction means in the desired angular position. Rotation of the aerial must be effected within a given rotation torque, which must be maintained within admissible tolerance limits throughout the life of the product. Furthermore, this rotation torque must be such that the user is able to adjust the position of the aerial, without recourse to any tool, thereby positioning the aerial at any angle possible within the admissible arc.

This is achieved by means of a controlled grip between the fixed part, or base, and the moving part, or aerial, in such a way that the friction between both generates the rotation torque, and defines the retention in a position at any given time. This controlled grip is usually achieved by means of a bolt which passes freely through both components screwing into a nut which is held in position by means of a rotation-lock arrangement, with interpolation of a standardized flexible washer (type DIN 2093) to maintain the rotation torque throughout the admissible arc of rotation. Since both components, in contact and subject to friction, are also required to achieve the continuity of electrical contact allowing the passage of the radio signal, it is not possible to interpose between them any non-conducting articles.

These known mounting bases are subject to two principal disadvantages.

The first of the disadvantages lies in the fact that the rotation torque obtained depends directly on the gripping torque of the bolt. In order to obtain a pre-set rotation torque and to maintain it within the admissible tolerances, a perfectly controlled gripping torque has to be imparted to the bolt, thereby necessitating the use of expensive gripping and control means, yet without the guarantee of complete reliability, since there are other factors such as thread profile, alignments, etc. which can cause variations in the correlation between gripping torque and rotation torque.

The second of the disadvantages resides in the fact that because the rotation torque is based upon friction between two metal components subjected to considerable pressure, the components are subject to wear due to rotational movements of the moving component. Initially this wear can be remedied by provision of the flexible washer already referred to, but since its compression is very limited, after a few operations its function is lost thus resulting in the loss of grip and thereby the capacity of the moving component to be retained in its previously adjusted angular position.

SUMMARY OF THE INVENTION

This invention is intended to remedy the above disadvantages, providing a holding device for aerials which is easy to fit and install, without the need for precision tools, and for which the rotation torque is maintained essentially constant throughout the life of the device. For that purpose and in accordance with the invention, the pressure or grip between moving and fixed components of the assembly is achieved, not by a bolt, but by a helical spring of relatively long stroke which is mounted under high compression, bearing at one end upon a fixed component element and at the other end upon a moving component element which in turn presses against the other element of the fixed component.

The wear undergone by these two contacting elements due to friction, that is the increased stroke of the spring which may result from the wear, will always represent a minimal percentage of the overall spring stroke, since the pressure it generates, depending directly on the rotation torque, is maintained essentially constant however long the life of the device and however frequently the aerial or the moving component are adjusted.

The invention is more easily understood on considering the appended drawings showing an exemplary holding device of the instant invention which example is not intended to limit the scope of the invention.

DETAILED DESCRIPTION OF THE PREFERRED EMBODIMENT

Figure 1:
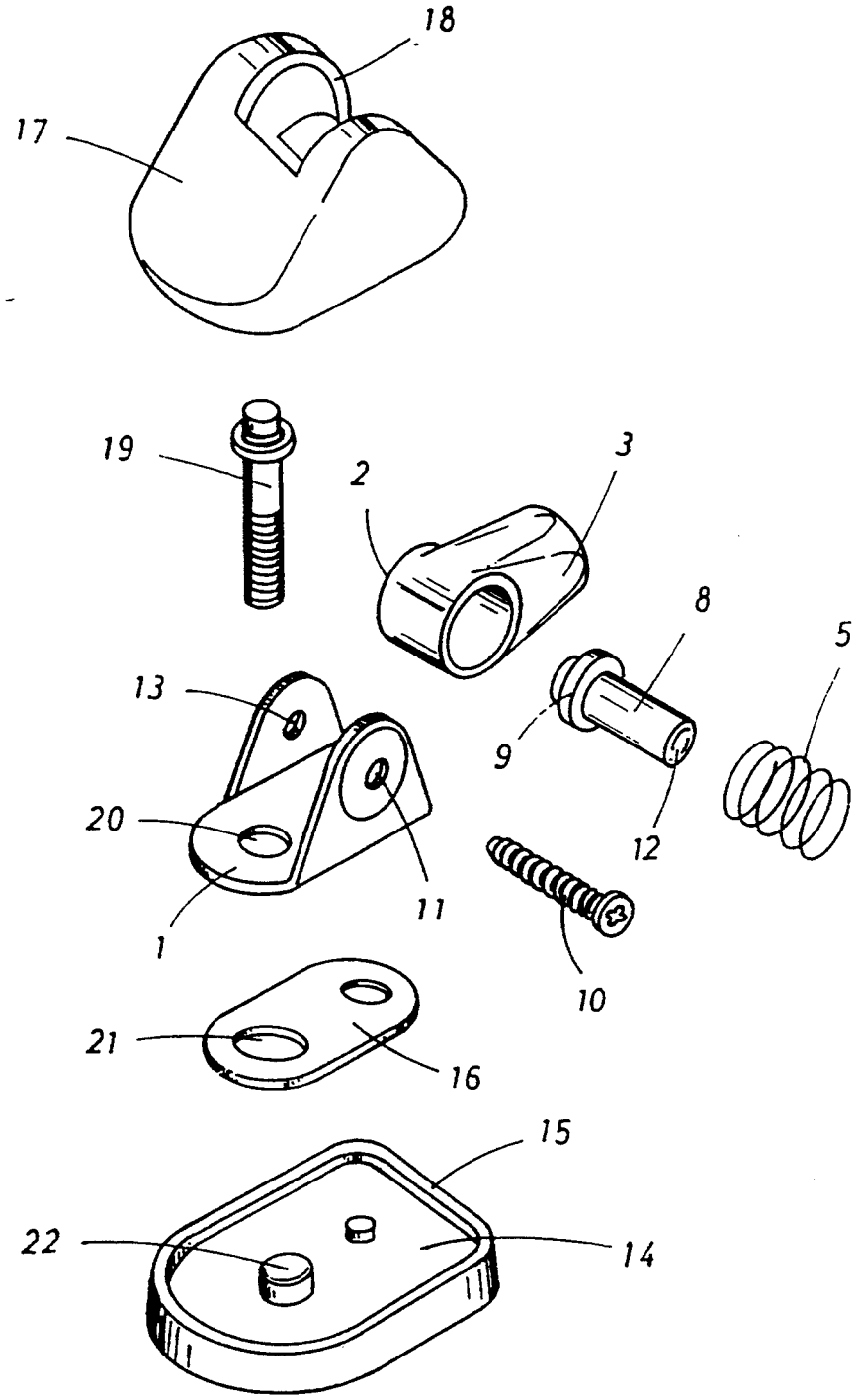
FIG. 1 is a perspective exploded view of an example of a suitable holding device for an aerial.
Figure 2:
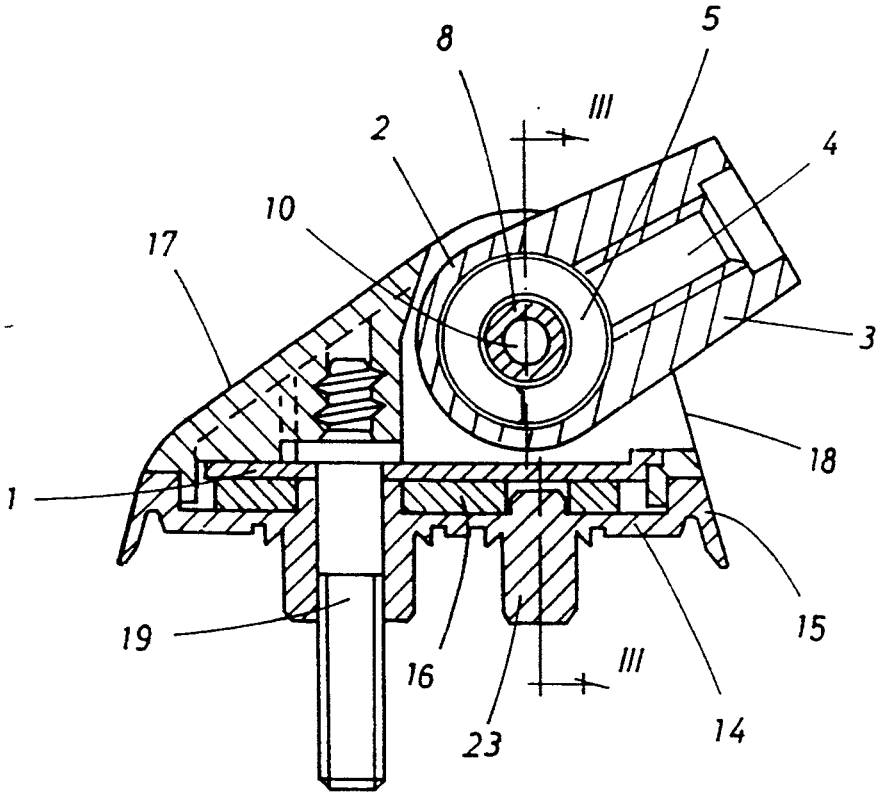
FIG. 2 is a cross-sectional view of the holding device of FIG. 1 suitably mounted which section is through line II—II of FIG. 3.
Figure 3:
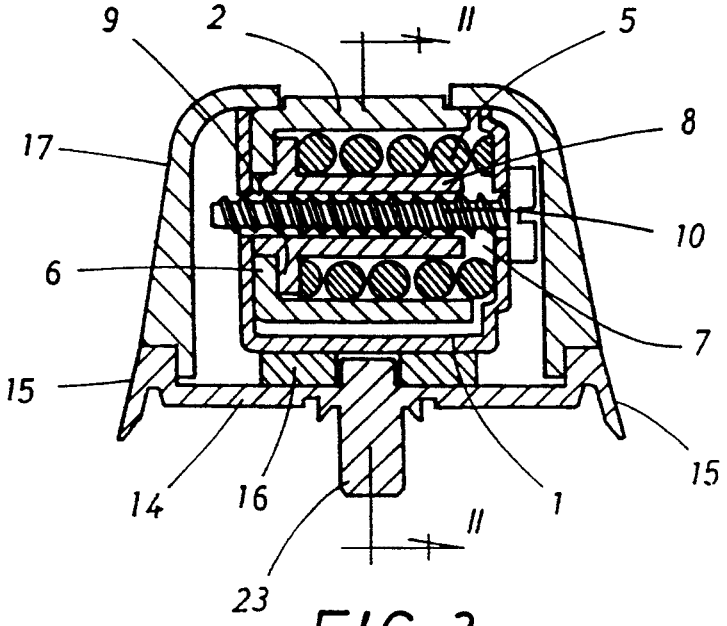
FIG. 3 is a section through line III—III of FIG. 2.

Referring now to the drawings:

The basic mechanism of the holding device for aerials of the invention includes a U-shaped metal support 1, forming the fixed component of the system, which is to be installed onto the roof of the vehicle, or onto another supporting surface. Securing of the device may be completed by any means deemed appropriate, being already known or eventually developed, the support 1 allowing direct application to the surface, for example by the provision of two parallel cut and fold back lugs formed from suitable material.

The second essential component of the mechanism consists of a bush or movable component 2 located between two side branches of support 1, forming the moving part of the system, to which is rigidly secured the aerial (not shown) which is capable of angular movement. The aerial may be of any known form or structure. Securement of the component 2 and aerial may be achieved by whatever system is deemed suitable, including one-piece construction of the two components. A preferred, though not essential, form of attachment involves the radial extension of the component 2 into a stub 3, with an axial threaded aperture 4, into which is coupled the end of the aerial.

In accordance with the invention, between the two components 1 & 2 a helical spring 5 is provided, fitted under considerable compression within the component 2 and expanding between a rim 6 thereof and one of the side branches of the support 1, within which a circular depression 7 is preferably provided to encase one end of the spring 5. The expansion force of the spring, which, can be calculated with absolute precision, compresses the rim 6 of the component 2 against the opposing side-branch of support 1, thus determining the friction force existing between the two components, and finally controlling the rotation torque.

Forming an important feature of the invention, the spring 5 is neither mounted directly inside the component 2 nor reacts directly upon it, but is mounted on a shaft 8, which is located axially inside the component 2. Accordingly, the spring 5 is interposed between the component 2 and the shaft 8 which has a peripheral rib or flange 9 against which one end of the spring 5 bears. The expansion force of the spring 5 with one end bearing against the depression 7, and the other end bearing against the flange 9, forces the flange 9 towards the rim 6 of the component 2 and the latter towards the opposing side-branch of the U-shaped support 1.

According to another feature of the invention, a bolt 10 is provided, passing freely through the aperture 11 in one of the side-branches of the U-shaped support 1 and through the axial aperture 12 of the shaft 8 finally screwing into the aperture 13 in the other side-branch of the support 1. This bolt 10 has no relationship to the expansion force of the spring 5, that is, it has no effect on the friction force between the fixed and moving components of the system, and its main function is to prevent the expansion force from causing the opening of the U-shaped support, that is to maintain the parallel relationship between the two side-branches of the support. Accordingly, it will be understood that this bolt may be replaced by a rivet or other similar component.

The assembly of the unit as outlined presents no difficulty and can be easily automated. Assembly of the unit may for example involve axially introducing the shaft 8 into the component 2 up to the furthermost position defined by the rib 9 which butts against the edge 6, the spring 5 is then located inside the component 2, surrounding the shaft 8. Having assembled the unit the spring is compressed and the assembly thus obtained, still maintaining the compression, is placed in the recess defined by the two wings or side-branches of the U-shaped support 1. This operation is facilitated by the depression 7 located in one of the branches of the support, wherein under its own pressure it encases the end of the spring. Finally, as already stated, the bolt 10 is located in the axial position, ensuring that the two side-branches of the U-shaped support remain in the correct position.

It will be understood that the expansion force of the spring 5, upon which the friction force preventing movements of the system depends, can be calculated with exact precision, in accordance with the properties to be achieved.

It will also be understood that the margin of compression of the spring 5 allows considerable wear to be absorbed, of the order of several millimeters, whereas in known systems any wear above a few tenths of a millimeter results in serious malfunctions of the device.

Another important advantage of the invention lies in the fact that the assembly as referred to, that is, the assembly consisting of components 1, 2, 5 and 8 suitably assembled, forms a compact and independent mechanism, suitable for large volume production for fitting to various securing means and able to be provided within various trim and protection housings, which is suitable for installation to various support surfaces, various assembly systems and to achieve widely varying decorative effects as desired. It will be understood that cover housing and securing base may take various constructions or designs while still remaining within the scope of the invention claimed.

In the drawings to which reference has been made as an example a traditional fitting system may include a flattened pedestal 14, made of flexible and elastic material, which is the component intended for securement to the vehicle bodywork and to be pressed upon it, ensuring a hermetic join, due to its elasticity and the lipped shape adopted around its periphery 15. The base of the support 1 rests upon this pedestal, with the interposition of a plate 16 which is intended to distribute the pressure of the base 1 upon the pedestal to achieve the seal. Finally, a housing 17 is placed over the pedestal covering the whole of the mechanism and having a wide aperture 18, through which passes to the outside, the stub 3 of the component 2 ready to rotate according to the maximum arc as already defined. The housing 18 is secured by a stud 19 which passes through the support 1, the plate 16 and the pedestal 14 by means of corresponding apertures 20, 21, 22 (the latter one having a suitable rim) also passing through an aperture provided in the vehicle bodywork, finally receiving the securing nut. Prevention of the pedestal rotating in relation to the bodywork may for instance be ensured, by the provision of a projecting pin 23 passing through a second aperture provided therein. It will be understood that the pressure developed by the securing nut once it has been fully secured, will determine the elastic distortion of the whole assembly of the pedestal against the bodywork, ensuring a satisfactory seal for the join.

I claim:

1. A holding device for aerials comprising:

a support formed from conductive material having a pair of side-branches;

a movable component pivotally mounted between said side-branches, said movable component having attachment means for an aerial; and a compressed spring located inside said movable component, said spring expanding between one of said side-branches against which said spring bears and a rim provided in said movable component, said rim being forced towards the other side-branch by expansion of said spring so as to generate a substantially constant frictional force for constricting rotational movement of the aerial and thus providing retention thereof in any selected position throughout a rotational range of said movable component regardless of how many times the movable component is rotated with respect to the support.

2. The holding device for aerials of claim 1 wherein a shaft is located coaxially inside said movable component, said shaft being encased by said spring and having a peripheral rib adjacent one end thereof, one end of said spring bearing against said rib, forcing said peripheral rib against said rim of the movable component and forcing said rim of the movable component against the adjacent side-branch of the support.

3. The holding device for aerials of claim 1 wherein said movable component has a radially projecting stub, said stub having attachment means for securing the proximal end of an aerial.

4. The holding device of claim 1 wherein said support is a metallic U-shaped member; the side-branches of which are substantially parallel.

5. The holding device for aerials of claim 4 wherein the two side-branches of the U-shaped member are held in the substantially parallel position by means of a fastener passing coaxially through the U-shaped member and the movable component.

6. The holding device for aerials of claim 5 wherein the fastener comprises a bolt which freely passes through an aperture in one of the side-branches of the U-shaped member, and is secured at a corresponding aperture in the opposing side-branch.

7. The holding device for aerials of claim 4 wherein the side-branch of the U-shaped member against which the spring bears directly has a circular depression in which the end of the spring is positioned.

8. The holding device for aerials of claim 4 wherein the aerial is a car aerial and the U-shaped member is positioned on a pressure distributor plate which is seated upon a flat, flexible elastic pedestal.

9. The holding device for aerials of claim 8 wherein a housing is positioned upon said pedestal which substantially covers said U-shaped member and has an aperture of a suitable size therethrough to permit in determined manner rotational movement of the aerial in both directions.

10. A holding device for aerials comprising:

a U-shaped member formed from conductive material having a pair of substantially parallel side-branches;

a movable component pivotally mounted between said side-branches, said movable component having attachment means for an aerial;

a compressed spring located inside said movable component, said spring expanding between one of said side-branches and a rim provided in said movable component, said rim being forced towards the other side-branch by expansion of said spring thus generating a frictional force for constricting rotational movement of the aerial and thus determining the retention thereof in a selected position;

a shaft located coaxially inside said movable component, said shaft being encased by said spring and having a peripheral rib adjacent one end thereof, one end of said spring bearing against said rib, forcing said peripheral rib against said rim of the movable component and forcing said rim of the movable component against the adjacent side-branch of the U-shaped member; and a fastener passing coaxially through the U-shaped member and passing freely and coaxially through the movable component and the shaft, for holding the side-branches of the U-shaped member in the substantially parallel position.

* * * * *